US009629467B2

(12) United States Patent
Brill et al.

(10) Patent No.: US 9,629,467 B2
(45) Date of Patent: Apr. 25, 2017

(54) METHOD FOR MANUFACTURING A MULTI-LAYERED SUPPORT STRUCTURE

(71) Applicant: Herman Miller, Inc., Zeeland, MI (US)

(72) Inventors: Ryan S. Brill, Allendale, MI (US); Christopher C. Hill, Zeeland, MI (US); James D. Slagh, Holland, MI (US); Andrew B. Hartmann, Muskegon, MI (US); Timothy P. Coffield, Grand Rapids, MI (US); Kelly E. Washburn, Allegan, MI (US); John F. Aldrich, Grandville, MI (US); Michael D. Stanton, Sr., Rockford, MI (US)

(73) Assignee: Herman Miller, Inc., Zeeland, MI (US)

( * ) Notice: Subject to any disclaimer, the term of this patent is extended or adjusted under 35 U.S.C. 154(b) by 491 days.

(21) Appl. No.: 14/245,789

(22) Filed: Apr. 4, 2014

(65) Prior Publication Data

US 2014/0298658 A1 Oct. 9, 2014

Related U.S. Application Data

(62) Division of application No. 12/509,118, filed on Jul. 24, 2009, now Pat. No. 8,691,370.

(Continued)

(51) Int. Cl.

*A47C 7/00* (2006.01)
*A47C 7/22* (2006.01)

(Continued)

(52) U.S. Cl.

CPC ..... *A47C 7/22* (2013.01); *A47C 7/287* (2013.01); *A47C 23/002* (2013.01); *E04C 3/00* (2013.01);

(Continued)

(58) Field of Classification Search

CPC ..... A47C 7/22; A47C 7/287; A47C 23/002
See application file for complete search history.

(56) References Cited

U.S. PATENT DOCUMENTS 1,982,516 A 11/1934 Holmested
2,233,592 A 3/1941 Dunajeff (Continued)

FOREIGN PATENT DOCUMENTS

BE 628357 5/1963
DE 9312478.3 10/1993

(Continued)

OTHER PUBLICATIONS

Sitting Machine Photograph, Circa 1987-88, 1 pg.

(Continued)

*Primary Examiner* — Timothy Kennedy
(74) *Attorney, Agent, or Firm* — Michael Best & Friedrich LLP

(57) ABSTRACT

A method for manufacturing a multi-layered support structure provides ergonomic, adaptable seating support. The method providing multiple cooperative layers to maximize global comfort and support while enhancing adaptation to localized variations in a load, such as in the load applied when a person sits in a chair. The cooperative layers each include elements such as pixels, springs, support rails, and other elements to provide this adaptable comfort and support. The method for manufacturing the multi-layered support structure uses aligned material to provide a flexible yet durable support structure. Accordingly, the method provides a multi-layered support structure, which provides maximum comfort for a wide range of body shapes and sizes.

20 Claims, 14 Drawing Sheets

Related U.S. Application Data

(60) Provisional application No. 61/135,997, filed on Jul. 25, 2008, provisional application No. 61/175,670, filed on May 5, 2009.

(51) Int. Cl.
*A47C 7/28* (2006.01)
*A47C 23/00* (2006.01)
*E04C 3/00* (2006.01)

(52) U.S. Cl.
CPC .... *Y10T 29/49623* (2015.01); *Y10T 29/49885* (2015.01); *Y10T 428/2495* (2015.01); *Y10T 428/24322* (2015.01); *Y10T 428/24331* (2015.01); *Y10T 428/24479* (2015.01); *Y10T 428/24612* (2015.01); *Y10T 428/24802* (2015.01); *Y10T 428/24942* (2015.01); *Y10T 428/24992* (2015.01)

(56) References Cited

U.S. PATENT DOCUMENTS 2,433,012 A 12/1947 Zalicovitz
2,549,902 A 4/1951 Hibbard et al.
2,897,879 A 8/1959 Brown et al.
3,081,129 A 3/1963 Ridder
3,174,741 A 3/1965 Wolff
3,198,578 A 8/1965 Geoffrey et al.
3,233,885 A 2/1966 Propst
3,242,512 A 3/1966 Beckman
3,251,077 A 5/1966 Beckman
3,255,470 A 6/1966 Knittel et al.
3,261,037 A 7/1966 Cermak et al.
3,262,137 A 7/1966 Beckman et al.
3,262,138 A 7/1966 Knittel
3,263,247 A 8/1966 Knittel et al.
3,276,048 A 10/1966 Beckman
3,280,410 A 10/1966 Propst et al.
3,340,548 A 9/1967 Janapol
3,386,876 A 6/1968 Wyckoff
3,393,012 A 7/1968 Chancellor, Jr.
3,559,978 A 2/1971 Molt
3,591,876 A 7/1971 Swindlehurst
3,633,228 A 1/1972 Zysman
3,681,797 A 8/1972 Messner
3,716,875 A 2/1973 Fehr
3,767,261 A 10/1973 Rowland
3,774,967 A 11/1973 Rowland
3,790,150 A 2/1974 Lippert
3,806,576 A 4/1974 Richardson et al.
3,843,477 A 10/1974 Rowland
3,889,302 A 6/1975 Ketterer et al.
3,940,811 A 3/1976 Tomikawa et al.
3,999,234 A 12/1976 Regan
4,033,567 A 7/1977 Lipfert
4,036,526 A 7/1977 Baechle et al.
4,190,914 A 3/1980 Diallo
4,283,864 A 8/1981 Lipfert
4,286,344 A 9/1981 Ikeda
4,367,897 A 1/1983 Cousins
4,383,342 A 5/1983 Forster
4,399,574 A 8/1983 Shuman
4,415,147 A 11/1983 Biscoe et al.
4,509,510 A 4/1985 Hook
4,559,656 A 12/1985 Foster
4,605,582 A 8/1986 Sias et al.
4,644,593 A 2/1987 O'Brien
4,673,605 A 6/1987 Sias et al.
4,686,724 A 8/1987 Bedford
4,713,854 A 12/1987 Graebe
4,744,351 A 5/1988 Grundei et al.
4,809,374 A 3/1989 Saviez
4,826,249 A 5/1989 Bradbury
4,879,084 A * 11/1989 Parnigoni ..... B29C 51/00 264/295
4,890,235 A 12/1989 Reger et al.
4,914,178 A 4/1990 Kim et al.
4,972,351 A 11/1990 Reger et al.
4,980,936 A 1/1991 Frickland et al.
5,025,519 A 6/1991 Spann et al.
5,105,488 A 4/1992 Hutchinson et al.
5,153,956 A 10/1992 Nold
5,163,196 A 11/1992 Graebe et al.
5,165,125 A 11/1992 Callaway
5,239,715 A 8/1993 Wagner
5,316,375 A 5/1994 Breen
5,328,245 A 7/1994 Marks et al.
5,426,799 A 6/1995 Ottiger et al.
5,452,488 A 9/1995 Reinhardt
5,459,896 A 10/1995 Raburn et al.
D368,399 S 4/1996 Buffon
5,502,855 A 4/1996 Graebe
5,533,220 A 7/1996 Sebag et al.
5,558,314 A 9/1996 Weinstein
5,558,398 A 9/1996 Santos
5,572,804 A 11/1996 Skaja et al.
5,588,165 A 12/1996 Fromme
5,615,869 A 4/1997 Phillips et al.
5,624,161 A 4/1997 Sorimachi et al.
5,628,079 A 5/1997 Kizemchuk et al.
5,632,473 A 5/1997 Dias Magalhaes Queiroz
5,638,565 A 6/1997 Pekar
5,720,471 A 2/1998 Constantinescu
5,747,140 A 5/1998 Heerklotz
5,785,303 A 7/1998 Kutschi
5,787,533 A 8/1998 Fromme
5,810,438 A 9/1998 Newhouse
5,820,573 A 10/1998 Ramos
5,975,641 A 11/1999 Delesie
5,976,451 A 11/1999 Skaja et al.
6,015,764 A 1/2000 McCormack et al.
6,029,962 A 2/2000 Shorten et al.
6,052,852 A 4/2000 Huang
6,059,368 A 5/2000 Stumpf et al.
6,098,313 A 8/2000 Skaja
6,101,651 A 8/2000 Tang
6,106,752 A 8/2000 Chang et al.
6,110,382 A 8/2000 Wiemers et al.
6,113,082 A 9/2000 Fujino
6,134,729 A 10/2000 Quintile et al.
6,170,808 B1 1/2001 Kutschi
6,217,121 B1 4/2001 Mollet
6,343,394 B1 2/2002 Gandolfi
6,353,953 B1 3/2002 Tanaka et al.
6,360,522 B1 3/2002 Walton
6,382,603 B1 5/2002 Monson et al.
6,406,009 B1 6/2002 Constantinescu et al.
6,425,153 B1 7/2002 Reswick
6,427,990 B1 8/2002 Hartmann
6,477,727 B1 11/2002 Fromme
6,540,950 B1 4/2003 Coffield
6,546,578 B1 4/2003 Steinmeier
6,598,251 B2 7/2003 Habboub et al.
6,663,178 B2 12/2003 Fourrey et al.
D486,027 S 2/2004 Baxter et al.
6,726,285 B2 4/2004 Caruso et al.
6,901,617 B2 6/2005 Sprouse, II et al.
6,986,182 B2 1/2006 Mossbeck
7,096,549 B2 8/2006 Coffield
7,356,859 B2 4/2008 McCraw
7,406,733 B2 8/2008 Coffield et al.
7,441,758 B2 10/2008 Coffield et al.
2002/0017347 A1 2/2002 Nanni et al.
2002/0106479 A1 8/2002 Coffield et al.
2002/0117885 A1 8/2002 Barile, Jr. et al.
2002/0175165 A1 11/2002 Jones
2003/0001424 A1 1/2003 Mundell et al.
2004/0195743 A1 10/2004 Pfau et al.
2004/0245839 A1 12/2004 Bodnar et al.
2004/0245840 A1 12/2004 Tubergen et al.
2004/0245841 A1 12/2004 Peterson et al.
2005/0116526 A1 6/2005 VanDeRiet et al.
2005/0268488 A1 12/2005 Hann
2005/0279591 A1 12/2005 Coffield et al.

(56) References Cited

U.S. PATENT DOCUMENTS

| | | | |
|---|---|---|---|
| 2006/0255645 | A1 | 11/2006 | Coffield et al. |
| 2006/0267258 | A1 | 11/2006 | Coffield et al. |
| 2006/0286359 | A1 | 12/2006 | Coffield et al. |
| 2007/0221814 | A1 | 9/2007 | Coffield et al. |
| 2007/0246873 | A1 | 10/2007 | VanDeRiet et al. |
| 2007/0262634 | A1 | 11/2007 | Brill et al. |
| 2008/0217977 | A1 | 9/2008 | Aldrich et al. |
| 2009/0020931 | A1 | 1/2009 | Coffield et al. |
| 2009/0020932 | A1 | 1/2009 | Coffield et al. |
| 2009/0085388 | A1 | 4/2009 | Parker et al. |
| 2009/0133195 | A1 | 5/2009 | Elzenbeck |
| 2009/0195047 | A1 | 8/2009 | Bouche et al. |

FOREIGN PATENT DOCUMENTS

| | | |
|---|---|---|
| DE | 29712721 | 9/1998 |
| EP | 0086578 | 8/1983 |
| EP | 0111898 | 6/1984 |
| EP | 0228350 | 7/1987 |
| EP | 0734666 | 10/1996 |
| EP | 0895739 | 2/1999 |
| EP | 0996349 | 5/2000 |
| EP | 1034726 | 9/2000 |
| EP | 1046361 | 10/2000 |
| EP | 1057433 | 12/2000 |
| EP | 1099397 | 5/2001 |
| EP | 1121880 | 8/2001 |
| EP | 1859768 | 11/2007 |
| GB | 2088206 | 6/1982 |
| JP | S60117748 | 8/1985 |
| JP | 200051010 | 2/2000 |
| JP | 2005532095 | 10/2005 |
| WO | WO 9903379 | 1/1999 |
| WO | WO 9922160 | 5/1999 |
| WO | WO 0115572 | 3/2001 |
| WO | WO 2005041719 | 5/2005 |
| WO | WO 2007131370 | 11/2007 |

OTHER PUBLICATIONS

Lattoflex Bettsystem, Winx 100, Jan. 2001, 16 pages.
Lattoflex Bettsystem, Winx 200, Jan. 2001, 20 pages.
Lattofiex Bettsystem, Winx 300, Jan. 2000, 20 pages.
Frolic website pages, printed Feb. 28, 2002, 52 pages.
Photo, "interlubke" support system, 1 page, date unknown.
Photo, "Ubila," 1 page, date unknown.
Office Action dated Mar. 7, 2007 for related United Kingdom Application Serial No. 0608532.8, 3 pages.
Office Action Dated Aug. 28, 2009 for related U.S. Appl. No. 11/433,891, 13 pages.
Combined Search Report & Examination Report dated Feb. 19, 2008, for related United Kingdom patent Application No. 0801934.1, 3 pages.
International Preliminary Report on Patentability dated Mar. 3, 2009, for related PCT International Application No. PCT/US2004/034933, 8 pages.
International Search Report and Written Opinion of the International Searching Authority dated Oct. 6, 2009, for related PCT International Application No. PCT International Application No. PCT/US2009/051221, 9 pages.
International Preliminary Report on Patentability dated Nov. 17, 2008, for related PCT International Application No. PCT/US2007/010625, 10 pages.
International Search Report and Written Opinion of the International Searching Authority dated Aug. 11, 2008, for related PCT International Application No. PCT/US2007/010625, 10 pages.
Office Action dated Jan. 14, 2009 for related Canadian Patent Application No. 2,542,978, 3 pages.
Office Action dated Jan. 25, 2008 for related Canadian Patent Application No. 2,542,978, 3 pages.
Office Action dated Oct. 9, 2007 for related United Kingdom Application No. 0608532.8, 1 page.
Office Action dated Apr. 10, 2009 for related U.S. Appl. No. 11/433,891, 9 pages.
Office Action dated Aug. 18, 2008 for related U.S. Appl. No. 11/433,881, 18 pages.
Office Action dated Jun. 8, 2009 for related U.S. Appl. No. 11/845,234, 13 pages.
Office Action dated Dec. 30, 2009 for related U.S. Appl. No. 11/645,234, 11 pages.
Office Action dated Jun. 23, 2010 for related U.S. Appl. No. 11/845,234, 9 pages.
Office Action dated Nov. 21, 2008 for related U.S. Appl. No. 10/972,153, 7 pages.
Office Action dated May 2, 2008 for related U.S. Appl. No. 10/972,153, 8 pages.
Office Action dated May 8, 2007 for related U.S. Appl. No. 10/972,153, 8 pages.
Office Action dated Nov. 3, 2006 for related U.S. Appl. No. 10/972,153, 7 pages.
Office Action dated Mar. 31, 2010 for related Canadian Patent Application No. 2,652,024, 2 pages.
Office Action dated Aug. 17, 2010 for related Chinese Patent Application No. 20078002518.X, 17 pages.
Office Action dated Jan. 4, 2011 for U.S. Appl. No. 11/423,540, 13 pages.
Office Action dated Oct. 27, 2010 for U.S. Appl. No. 11/423,540, 12 pages.
Office Action dated Jun. 14, 2010 for U.S. Appl. No. 11/423,540, 10 pages.
Office Action dated Jan. 5, 2011 for U.S. Appl. No. 12/211,340, 12 pages.
Office Action dated Sep. 28, 2010 for U.S. Appl. No. 12/211,340, 11 pages.
Office Action dated Apr. 27, 2010 for U.S. Appl. No. 12/211,340, 10 pages.
Office Action dated Mar. 2, 2011 for U.S. Appl. No. 12/241,646, 9 pages.
Office Action dated Sep. 2, 2010 for U.S. Appl. No. 12/241,646, 8 pages.
Nebel, Antonio et al., The Miracles of Science, Presentation Slides, Sep. 2003, 44 pages.
"""SKYDEX Smarter Cushioning,"" SKYDEX Technologies, Inc., http://www.skydex.com/technology.htm, 2002, 1 page."
Office Action dated Jan. 4, 2011 for U.S. Appl. No. 12/818,558, 10 pages.
Machine Translation of BE 628357, May 1963.
Office Action to Japanese Patent Application No. 2011-520131 dated Jan. 6, 2014 (2p).

* cited by examiner

METHOD FOR MANUFACTURING A MULTI-LAYERED SUPPORT STRUCTURE

PRIORITY CLAIM

This application is a divisional of U.S. patent application Ser. No. 12/509,118, filed Jul. 24, 2009, now issued as U.S. Pat. No. 8,691,370, which claims priority to both of U.S. Provisional Patent Application No. 61/135,997, filed Jul. 25, 2008, titled MULTI-LAYERED SUPPORT STRUCTURE, and U.S. Provisional Patent Application No. 61/175,670, filed May 5, 2009, titled MULTI-LAYERED SUPPORT STRUCTURE, which are incorporated herein by reference.

BACKGROUND OF THE INVENTION

1. Technical Field

The invention relates to load support structures. In particular, the invention relates to multi-layered seating structures.

2. Related Art

Most people spend a significant amount of time sitting each day. Inadequate support can result in reduced productivity, body fatigue, or even adverse health conditions such as chronic back pain. Extensive resources have been devoted to the research and development of chairs, benches, mattresses, sofas, and other load support structures.

In the past, for example, chairs have encompassed designs ranging from cushions to more complex combinations of individual load bearing elements. These past designs have improved the general comfort level provided by seating structures, including providing form-fitting comfort for a user's general body shape. Some discomfort, however, may still arise even from the improved seating structures. For example, a seating structure, though tuned to conform to a wide variety of general body shapes, may resist conforming to a protruding wallet, butt bone, or other local irregularity in body shape. This may result in discomfort as the seating structure presses the wallet or other body shape irregularity up into the seated person's backside.

Thus, while some progress has been made in providing comfortable seating structures, there remains a need for improved seating structures tuned to fit and conform to a wide range of body shapes and sizes.

SUMMARY

A method for manufacturing a multi-layered support structure provides ergonomic, adaptable seating support. The method providing multiple cooperative layers to maximize global comfort and support while enhancing adaptation to localized variations in a load, such as in the load applied when a person sits in a chair. The cooperative layers each include elements such as pixels, springs, support rails, and other elements to provide this adaptable comfort and support. The method for manufacturing the multi-layered support structure uses aligned material to provide a flexible yet durable support structure. Accordingly, the method provides a multi-layered support structure, which provides maximum comfort for a wide range of body shapes and sizes.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The method may be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

The layered support structure generally refers to an assembly of multiple cooperative layers for implementation in or as a load bearing structure, such as a chair, bed, bench, or other load bearing structures. The cooperative layers include multiple elements, including multiple independent elements, to maximize the support and comfort provided. The extent of the independence exhibited by the multiple elements may depend on, or be tuned to, individual characteristics of each element, the connection type used to interconnect the multiple elements, or other structural or design characteristics of the layered support structure. The multiple elements described below may be individually designed, positioned, or otherwise configured to suit the load support needs for a particular individual or application. The dimensions discussed below with reference to the various multiple elements are examples only and may vary widely depending on the particular desired implementation and on the factors noted below.

Figure 1:
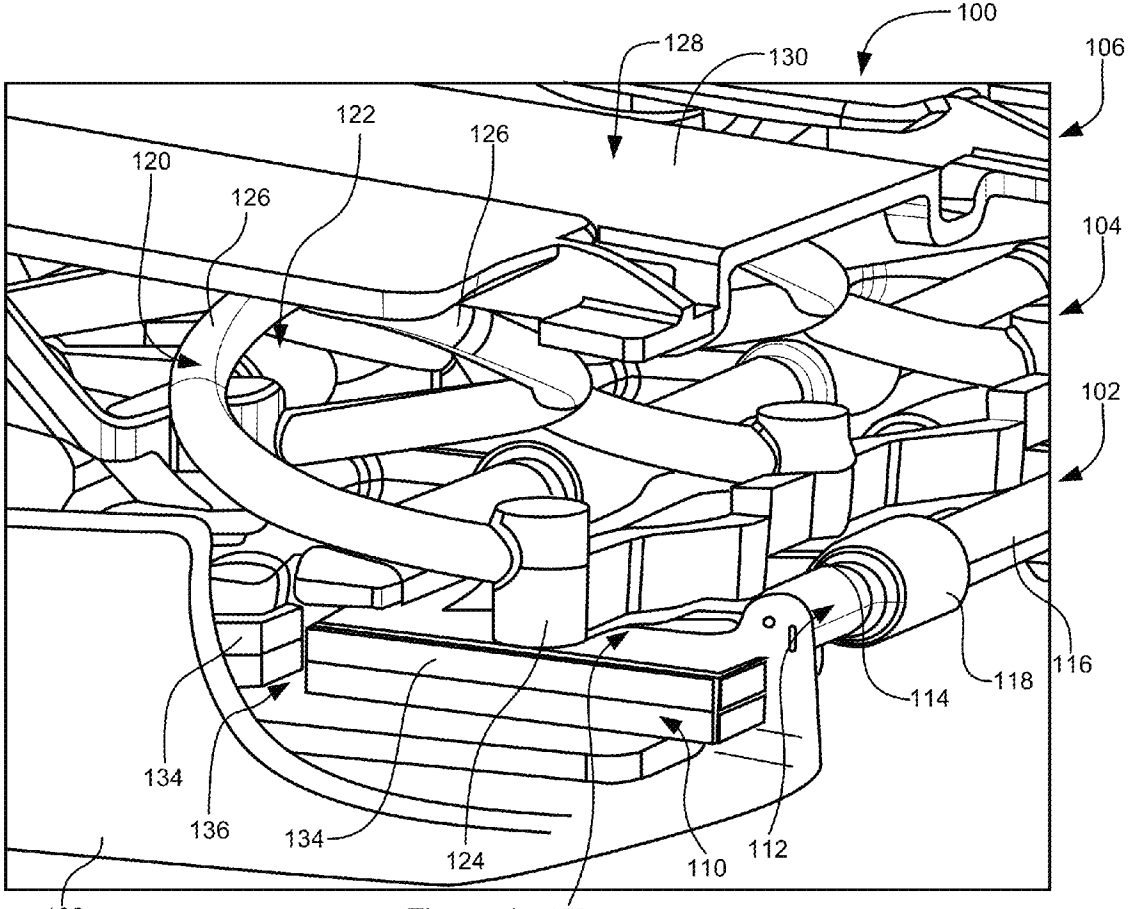
FIG. 1 shows a portion of a layered support structure.

FIG. 1 shows a portion of a layered support structure 100. The layered support structure 100 includes a global layer 102, a local layer 104, and a top mat layer 106.

The global layer 102 includes multiple support rails 108 and a frame attachment 110. Each support rail 108 may include one or more straps 112 and multiple nodes 114 connected between the straps 112. Each strap may include aligned regions 116 and unaligned regions 118 defined along the length of the strap 112. The nodes 114 may connect to adjacent straps between the unaligned regions 118 of the adjacent straps 112.

The local layer 104 includes multiple spring elements 120 above (e.g., supported by or resting on) the multiple support rails 108. Each of the multiple spring elements 120 includes a top, a deflectable member 122, and one or more node attachment members 124. In FIG. 1, the deflectable member 122 includes two spiral arms 126. The spring elements 120 may alternatively include a variety of spring types, such as those disclosed in U.S. application Ser. No. 11/433,891, filed May 12, 2006, which is incorporated herein by reference.

The top mat layer 106 includes multiple pixels and bull nose extension fingers 128. Each of the multiple pixels includes an upper surface and a lower surface. The lower surface of each pixel may include a stem which contacts the top of at least one of the spring elements 120. Each of the bull nose extension fingers 128 may also include an upper surface 130 and a lower surface. The lower surface of each bull nose extension finger 128 may include one or more stems that each contact with the top of at least one of the spring elements 120.

The global layer 102 may be injection molded from a flexible material such as a thermal plastic elastomer (TPE), including Arnitel EM400 or 460, a polypropylene (PP), a thermoplastic polyurethane (TPU), or other soft, flexible materials.

The global layer 102 connects to a frame 132 via the frame attachment 110. The frame attachment 110 may be connected to the end of the straps 112 of the support rails 108 and oriented substantially perpendicular to the straps 112. FIG. 1 shows a frame attachment 110 that includes discrete segments 134. The frame attachment 110 may define by a gap 136 between each segment 134. Each of the discrete segments 134 may connect to the ends of two or more adjacent straps 112. The frame attachment 110 may include a single segment extending along an entire side of the global layer 102, such as the frame attachment shown in FIG. 3.

In FIG. 1, each support rail 108 includes two cylindrical straps 112 extending substantially in parallel. The support rails 108, however, may include alternative configurations. For example, the support rails 108 may include a single strap, or multiple straps. The support rails 108 of the global layer 102 may include a varying number of straps 112 tailored to various factors, such as the location of the support rail 108 within the global layer 102. The support rails 108 may include alternative geometries. For example, the straps 112 of the support rails 108 may include four sides with multiple ends. An example of such straps is disclosed in U.S. application Ser. No. 11/433,891.

A strap 112 may include multiple aligned regions 116 and multiple unaligned regions 118 defined along the strap 112. The strap 112 may include alternating aligned and unaligned regions 116 and 118. Each of the aligned and unaligned regions may be defined by a cross-sectional area. The cross-sectional area of each aligned region defined along a strap may vary and be tailored to the position of the aligned region along the strap. The cross-sectional area may be proportional to the position of the aligned region relative to a gate location of the mold. For example, the gate location corresponds to the middle of the strap, where the aligned regions have a greater cross-sectional area the more distant they are from the middle. As shown in FIG. 1, the cross-sectional area of the unaligned regions may be greater than that of the adjacent aligned regions. The aligned regions defined along the straps of the support rails may be aligned using a variety of methods including compression and/or tension aligning methods.

Figure 4:
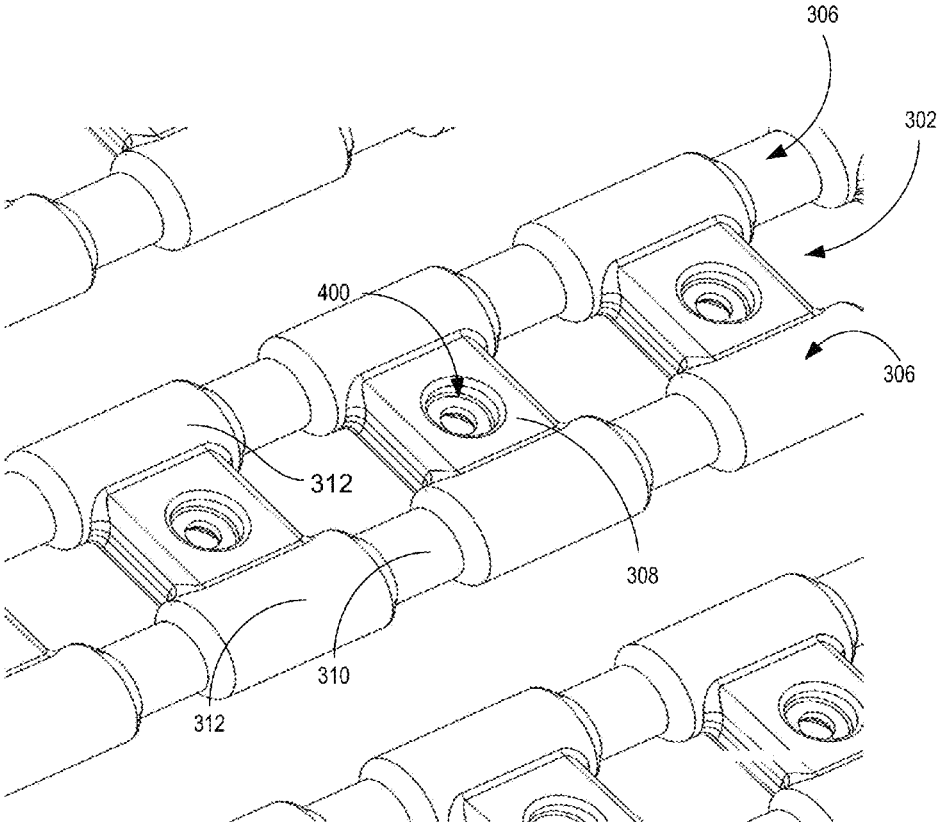
FIG. 4 shows a portion of the support rail including the node connected between two straps.

The unaligned region 118 and aligned region 116 of the adjacent straps 112 may substantially line up with each other. As shown in FIG. 1, the nodes 114 may connect between adjacent unaligned regions 118 of adjacent straps 112. Each node 114 may include a spring connection for connecting to a spring element 120 of the local layer. The spring connection may be an opening defined in the node 114 for receiving a corresponding spring element 120, such as shown in FIG. 4.

The global layer 102 may or may not be pre-loaded. For example, prior to securing the global layer 102 to the frame, the global layer 102 may be formed, such as through the injection molding process, with a shorter length than is needed to secure the global layer 102 to the frame. Before securing the global layer 102 to the frame, the global layer 102 may be stretched or compressed to a length greater than its original length. As the global layer 102 recovers down after being stretched, the global layer 102 may be secured to the support structure frame when the global layer 102 settles to a length that matches the width of the frame.

As another alternative, the global layer 102 may recover down and then be repeatedly re-stretched until the settled down length of the global layer 102 matches the width of the frame. The global layer 102 may be pre-loaded in multiple directions, such as along its length or its width. In addition, different pre-loads may be applied to different regions of the global layer 102. Applying different pre-loads according to region may be done in a variety of ways, such as by varying the amount of stretching or compression at different regions and/or varying the cross-sectional area of different regions.

The multiple spring elements 120 of the local layer 104 may include a variety of dimensions according to a variety of factors, including the spring element's relative location in the support structure 100, the needs of a specific application, or according to a number of other considerations. For example, the heights of the spring elements 120 may be varied to provide a three-dimensional counter to the support structure 100, such as by providing a dish-like appearance to the support structure 100. In this example, the height of the spring elements 120 positioned at a center portion of the local layer 104 may be less than the height of spring elements 120 positioned at outer portions of the local layer 104, with a gradual or other type of increase in height between the center and outer portions of the local layer 104.

The local layer 104 may include a variety of other spring types. Examples of other spring types, as well as how they may be implemented in a support structure, are described in U.S. application Ser. No. 11/433,891, filed May 12, 2006, which is incorporated herein by reference. The spring types used in the local layer 104 may include alternative orientations. For example, the spring types may be oriented upside-down, relative to their orientation described in this application. In this example, the portion of the spring described in this application as the top would be oriented towards and connect to the global layer 102. Further, in this example the deflectable members 122 may connect to the top mat layer 106. The deflectable members 122 may connect to the top mat layer 106 via multiple spring attachment members 124. However, the examples discussed in this application do not constitute an exhaustive list of the spring types, or possible orientations of spring types, that may be used to form the local layer 104. The spring elements 120 may exhibit a range of spring rates, including linear, non-linear decreasing, non-linear increasing, or constant rate spring rates.

The local layer 104 connects to the global layer 102. In particular, the spring attachment members 124 connect on the nodes 114 positioned between the unaligned regions 118 of adjacent straps 112. This connection may be an integral molding, a snap fit connection, or other connection method. The multiple spring elements 120 may be injection molded from a POM, such as Ultraform N 2640 Z6 UNC Acetal or Uniform N 2640 Z4 UNC Acetal, from a TPE, such as Arnitel EM 460, EM550, or EL630, a TPU, a PP, or from other flexible materials. The multiple spring elements 120 may be injection molded individually or as a sheet of multiple spring elements.

As the local layer 104 includes multiple substantially independent deflectable elements, i.e., the multiple spring elements, adjacent portions of the local layer 104 may exhibit substantially independent responses to a load. In this manner, the support structure 100 not only deflects and conforms under the "macro" characteristics of the applied load, but also provides individual, adaptable deflection to "micro" characteristics of the applied load.

The local layer 104 may also be tuned to exhibit varying regional responses in any particular zone, area, or portion of the support structure to provide specific support for specific parts of an applied load. The regional response zones may differ in stiffness or any other load support characteristic, for example. Certain portions of the support structure may be tuned with different deflection characteristics. One or more individual pixels which form a regional response zone, for example, may be specifically designed to a selected stiffness for any particular portion of the body. These different regions of the support structure may be tuned in a variety of ways. Variation in the spacing between the lower surface of each pixel and the local layer 104 (referring to the spacing measured when no load is present) may vary the amount of deflection exhibited under a load. The regional deflection characteristics of the support structure 100 may be tuned using other methods as well, including using different materials, spring types, thicknesses, cross-sectional areas, geometries, or other spring characteristics for the multiple spring elements 120 depending on their relative locations in the support structure.

The top mat layer 106 connects to the local layer 104. The lower surface of each pixel is secured to the top of a corresponding spring element 120. The lower surface of each bull nose extension finger 128 may also be secured to the top of one or more corresponding spring elements 120. These connections may be an integral molding, a snap fit connection, or other connection method. The lower surface of the pixel and/or bull nose extension finger 128 may connect to the top of the spring element 120, or may include one or more stems or other extensions for resting upon or connecting to the spring element 120. The top of each spring element 120 may define an opening for receiving the stem of the corresponding pixel or bull nose extension finger 128. Alternatively, the top of each spring element 120 may include a stem or post for connecting to an opening defined in the corresponding pixel or bull nose extension finger 128.

When a load presses down on the top mat layer 106, the multiple pixels press down on the tops of the multiple spring elements 120. In response, the multiple spring elements 120 deflect downward to accommodate the load. The amount of deflection exhibited by an individual spring element 120 under a load may be affected by a spring deflection level associated with that spring element 120. As the multiple spring elements 120 deflect downward, the lower surfaces of the multiple pixels and/or multiple bull nose extension fingers 128 move toward the global layer 104. Relative to the ground, however, the spring elements 120 may deflect further in that the local layer 104 may deflect downward under a load as the global layer 102 deflects under the load. As such, the spring elements 120 may individually deflect under a load according to the spring deflection level, and may also, as part of the local layer 104 as a whole, deflect further as the global layer 102 bends downward under the load.

The spring deflection level may be determined before manufacture and designed into the support structure 100. For example, the support structure 100 may be tuned to exhibit an approximately 25 mm of spring deflection level. In other words, the support structure 100 may be designed to allow the multiple spring elements 120 to deflect up to approximately 25 mm. Thus, where the local layer 104 includes spring elements of 16 mm height (i.e., the distance between the top of the global layer 102 and the top of the spring element), the lower surfaces of the multiple pixels may include a 9 mm stem. As another example, where the local layer 104 includes spring elements of 25 mm height, the lower surfaces of the multiple pixels may omit stems, but may connect to the tops of the multiple spring elements. As explained above, the height of each spring element 120 may vary according to a number of factors, including its relative position within the support structure 100.

Figure 8:
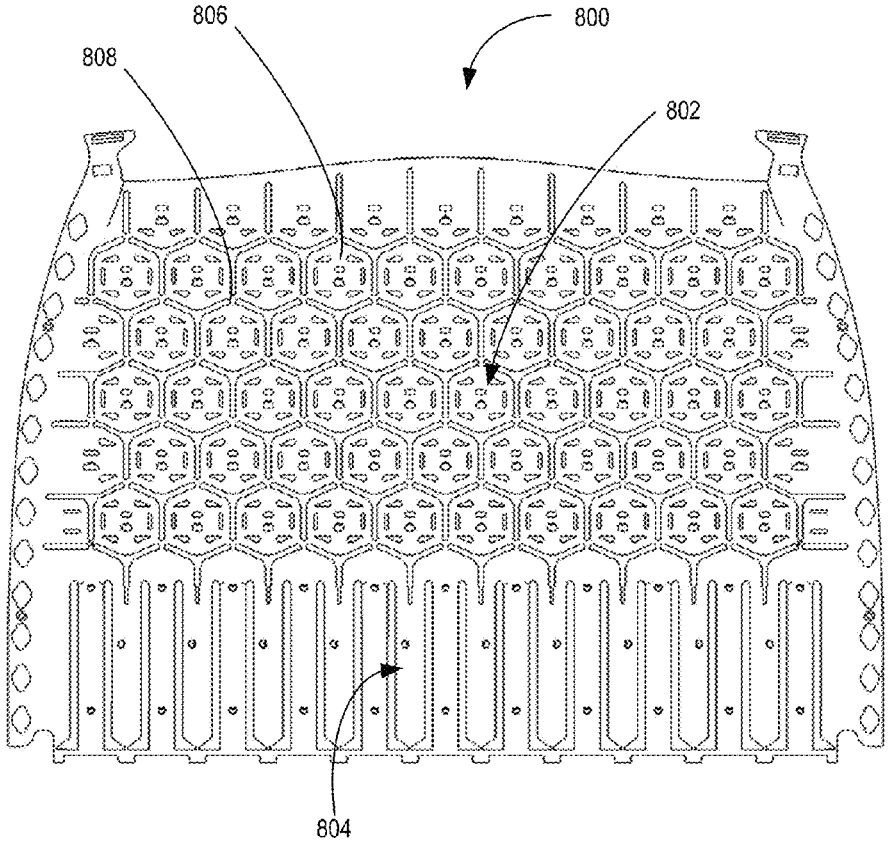
FIG. 8 shows a top view of a top mat layer.

The multiple pixels of the top mat layer 106 may be interconnected with multiple pixel connectors, as shown in FIG. 8 and described below. The top mat layer 106 may include a variety of pixel connectors, such as planar or non-planar connectors, recessed connectors, bridged connectors, or other elements for interconnecting the multiple pixels, as described below. The multiple pixel connectors may be positioned at a variety of locations with reference to the multiple pixels. For example, the multiple pixel connectors may be positioned at the corners, sides, or other positions in relation to the multiple pixels. The multiple pixel connectors provide an increased degree of independence as between adjacent pixels, as well as enhanced flexibility to the top mat layer 106. For example, the multiple pixel connectors may allow for flexible downward deflection, as well as for individual pixels to move or rotate laterally with a significant amount of independence.

The top mat layer 106 may be injection molded from a flexible material such as a TPE, PP, TPU, or other flexible material. In particular, the top mat layer 106 may be formed from independently manufactured pixels and bull nose extension fingers 128, or may be injection molded as a sheet of multiple pixels.

When under a load, the load may contact with and press down on the top mat layer 106. Alternatively, the support structure 100 may also include a covering layer secured above the top mat layer 106. The covering layer may include a cushion, fabric, leather, or other covering materials. The covering layer may provide enhanced comfort and/or aesthetics to the support structure 100.

Figure 2:
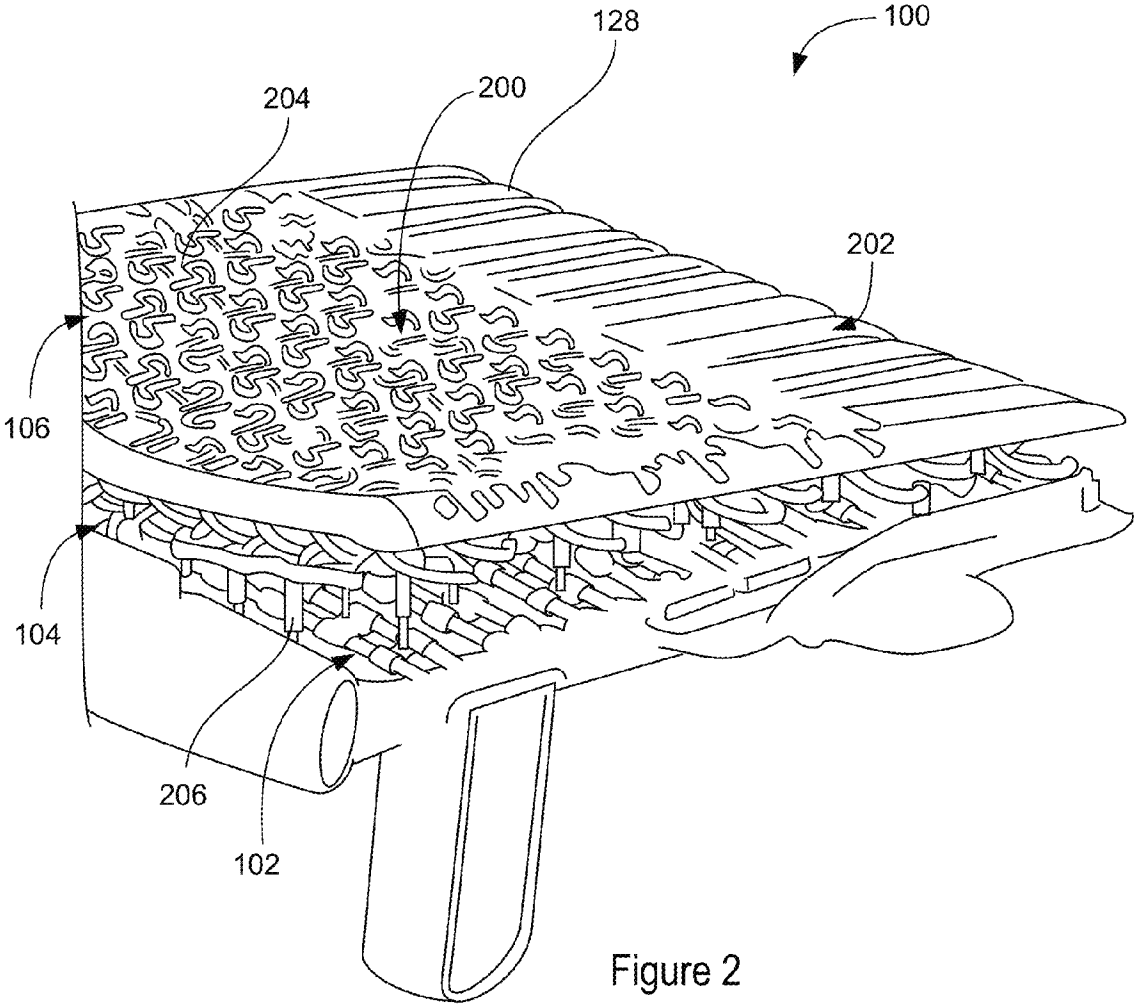
FIG. 2 shows a broader view of the support structure shown in FIG. 1.

FIG. 2 shows a broader view of the support structure 100 shown in FIG. 1. The top mat layer 106 is supported on the local layer 104, which is supported on the global layer 102. The global layer 102 is secured to the frame 132. While FIG. 2 shows a rectangular multi-layered support structure 100, the support structure 100 may include alternative shapes, including a circular shape.

The top mat layer 106 includes a pixel region 200 connected to a bull nose extension finger region 202. The pixel region 200 includes multiple interconnected pixels 204. The bull nose extension finger region 202 includes multiple interconnected bull nose extension fingers 128.

The top mat layer 106 also includes multiple pixel connectors to facilitate the connections between adjacent pixels 204 and bull nose extension fingers 128. The pixel connectors are described in more detail below and a close-up of one pixel connector is shown in FIG. 8.

The pixels 204 provide enhanced flexibility to the top mat layer 106. The pixels 204 may include stems for connecting to a local layer 104. The bull nose extension fingers 128 may facilitate connection of the top mat layer 106 to a seating structure. For example, the bull nose extension fingers 128 may be glidably inserted into a seating structure. For example, the seating structure may include tracks into which each bull nose extension finger glides.

FIG. 2 shows the spring attachment members 124 of the multiple spring elements 120. The spring attachment members 124 include a stem 206 extending downward towards the global layer 102. Each stem 206 may be inserted into and secured within an opening defined in a corresponding node 114 of the global layer 102. The stems 206 of the spring elements 120 are discussed in more detail below and are shown close-up in FIG. 6. The respective heights of the stems 206 may vary within the local layer 104 to provide counter to the support structure 100.

Figure 3:
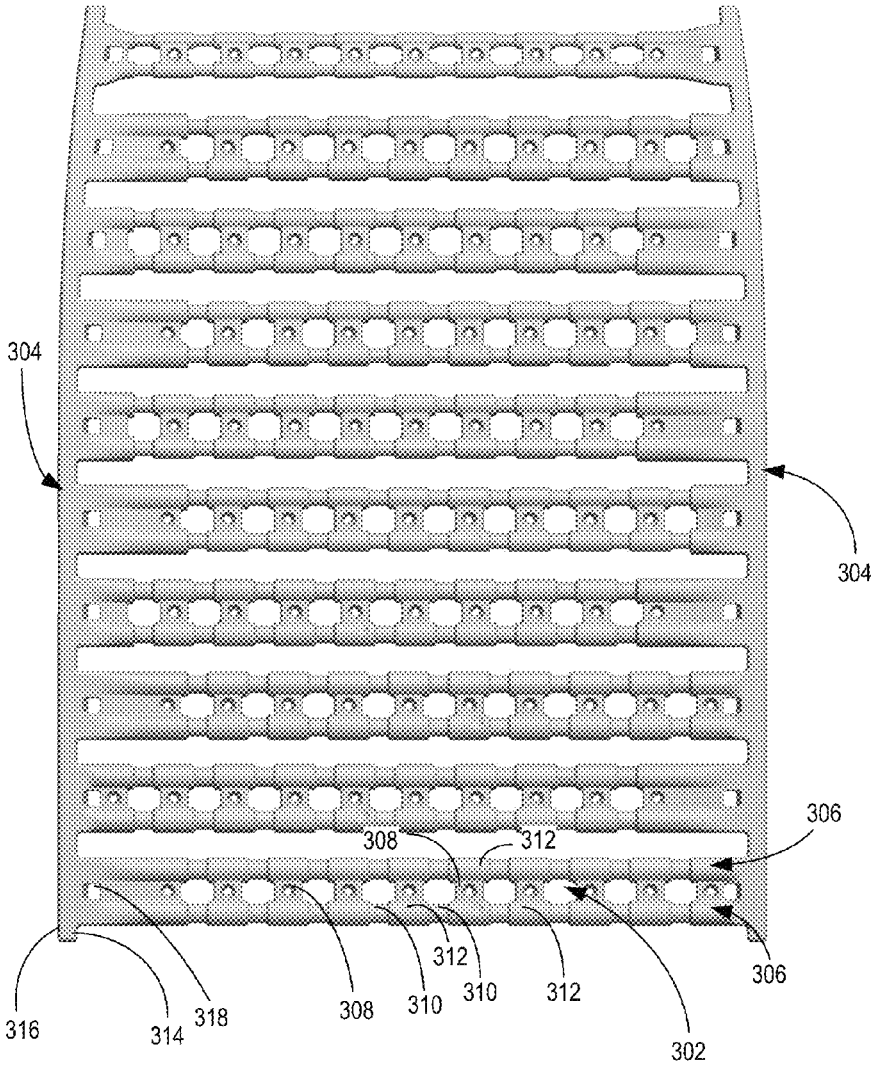
FIG. 3 shows a top view of a global layer.

FIG. 3 shows a top view of a global layer 300. As noted above in connection with FIG. 1, the global layer 300 includes multiple support rails 302 and one or more frame attachments 304. The ends of the support rails 302 connect between two substantially parallel frame attachments 304. In FIG. 3, the frame attachments 304 each comprise a unitary segment extending along the length of the frame attachment 304. As shown in FIG. 1, the frame attachments may include discrete segments.

The global layer 300 may be formed using an injection molding technique. In particular, the global layer 300 may be formed using a center gating injection molding technique in which the cavity mold is gated at or near positions of the cavity mold that correspond to the center of the support rails. An injection molding process may result in molding pressure loss within the molded apparatus, where the pressure loss may be greater in regions farther from the gate than regions closer to the gate. The center gating technique may facilitate symmetrical pressure loss along the support rails 302. As pressure loss can affect alignment, a symmetrical pressure loss within the support rails may facilitate symmetrical alignment within the support rails 302.

Each support rail 302 comprises two straps 306 and multiple nodes 308 connected between adjacent straps. Each strap 306 includes aligned regions 310 and unaligned regions 312 defined along the length of the strap 306. The aligned regions 310 may be defined by a cross-sectional area that is less than the cross-sectional area of the unaligned regions 312. The cross-sectional area of each aligned region 310 defined along a strap 306 may be tuned to the relative location of the aligned region 310 on the strap 306. The cross-sectional area of aligned regions 310 along a strap 306 may gradually increase the farther the aligned region 310 is from the center of the strap 306. The cross-sectional area of the aligned regions 310 may also be tuned to the relative position of each aligned region 310 from the position of the gate. The cross-sectional area of each aligned region 310 may increase by between about 0.1% to about 1%, such as by about 0.5%, the more distant the aligned region is from the position of the gate. For example, the cross-sectional area of an aligned region may be between about 0.1% and about 1% greater than the cross-sectional area of an aligned region on the strap that is immediately closer to the position of the gate.

The nodes 308 are connected between adjacent unaligned regions 312. The nodes 308 may comprise a spring connection for connecting the global layer 300 to the local layer. The spring connection may be an opening defined in the node 308 for receiving a stem or other protrusion from a spring element. The nodes 308 may connect to the spring elements with a snap-fit connection, a press fit, or be integrally molded together.

The frame attachments 304 facilitate connection of the global layer 300 to a frame. The frame attachments 304 may comprise an inside edge 314 and an outside edge 316. Each strap 306 that is part of a support rail 302 may include two ends that connect to the inside edges 314 of the frame attachments 304. The connection between the ends of adjacent straps 306 and the inside edge 314 of a frame attachment 304 may define an opening 318 between adjacent straps 306 along the inside edge 314 of the frame attachment 304.

FIG. 4 shows a portion of the support rail 302 including the node 308 connected between two straps 306. In particular, the node 308 is connected between the adjacent unaligned regions 312 of the two straps 306. Each strap 306 includes aligned regions 310 connected on either side of the corresponding unaligned region 312. The cross-sectional area of the unaligned region 312 may be greater than the cross-sectional area of the aligned regions 310.

The node 308 may include a spring connection 400 for connecting the global layer 300 to a local layer. In FIG. 4, the spring connection 400 is an opening defined in the node 308 for receiving a stem or other protrusion of the local layer. The spring connection may alternatively be a stem or protrusion extending vertically above the node 308 for mating with an opening defined in the local layer.

Figure 5:
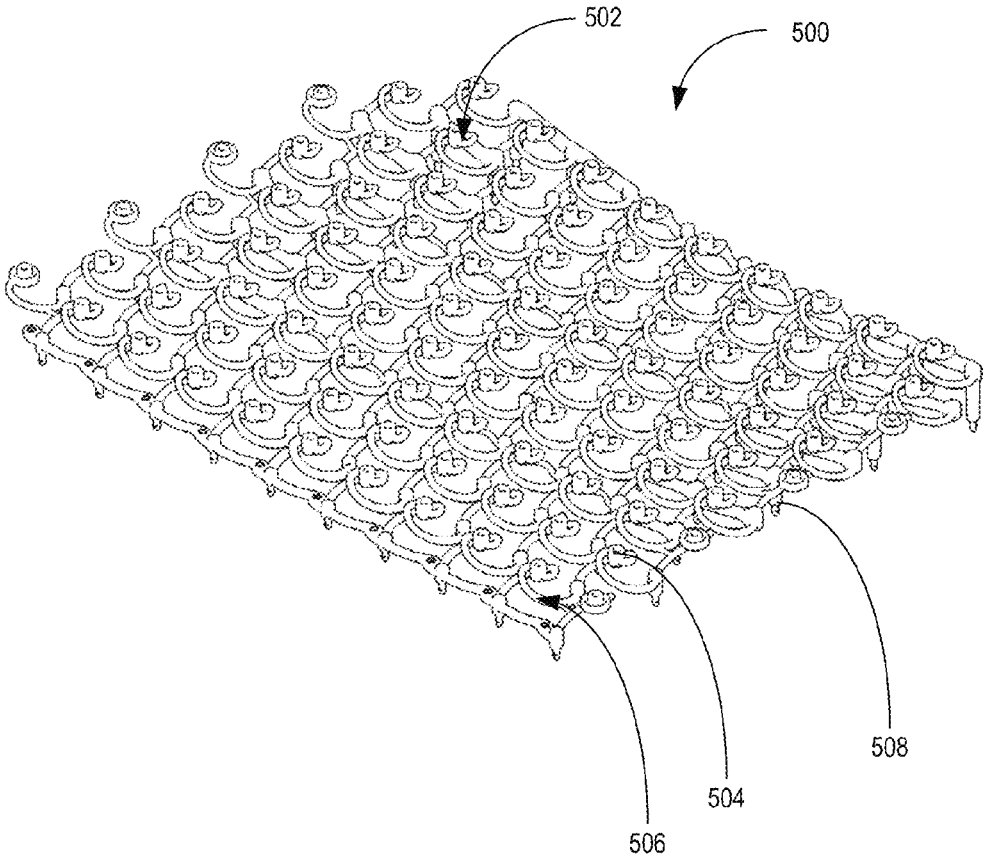
FIG. 5 shows a top view of a local layer.

FIG. 5 shows a top view of a local layer 500. The local layer 500 includes multiple interconnected spring elements 502. The local layer 500 may be formed from a unitary piece of material. Each of the spring elements 502 includes a top 504, at least one deflectable member 506, and a spring attachment member 508. The top 504 may define an opening for receiving a stem or other protrusion extending from the lower surface of a corresponding pixel of a top mat layer.

The deflectable member 506 includes two spiral arms connected to and spiraling away from the top 504. The cross-sectional area of the spiraled arms may be tapered or otherwise vary along the length of each arm. For example, the cross-sectional area of a spiral arm may gradually increase or decrease, beginning where the arm connects to the top 504, along the length of the spiral arm and be smallest where the spiral arm connects to the spring attachment member 508. The cross-sectional area of each spiral arm may be tailored to the relative location of the spring element 502 within the local layer 500, a desired spring rate of the spring element 500, or other factors.

The spiral arms may include or be connected to the spring attachment member 508. In FIG. 5, a spiral arm of two adjacent spring elements 502 connects the same spring attachment member 508.

The spring elements 502 are arranged in diagonal rows extending from one side of the local layer 500 to the other. The spring elements 502 may be interconnected with adjacent spring elements in the same diagonal row, but may not directly connect to spring elements in adjacent diagonal rows. In this configuration, spring elements 502 within a diagonal row may deflect or respond to a load substantially independently to the response of spring elements 502 in an adjacent diagonal row.

Figure 6:
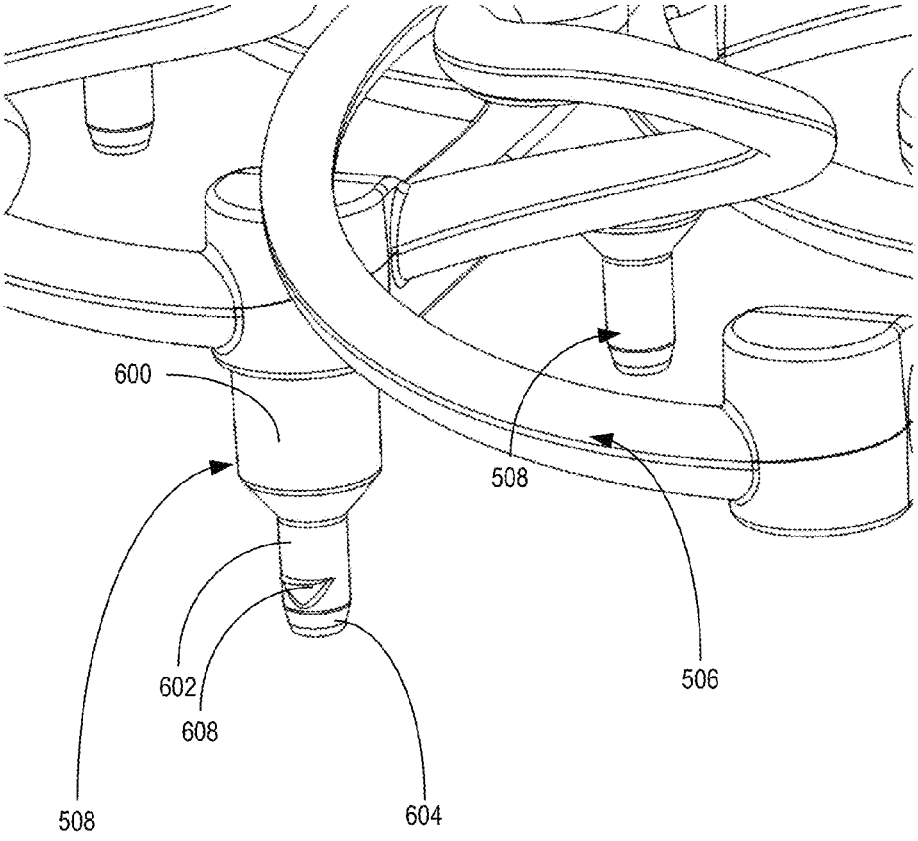
FIG. 6 shows a portion of the spring attachment member.

FIG. 6 shows a portion of the spring attachment member 508. In particular, FIG. 6 shows a portion of the stem that may fit into an opening defined in the global layer. The stem includes a first cylindrical portion 600 that tapers down into a second cylindrical portion 602, where the first cylindrical portion 600 has a greater cross-sectional area than does the second cylindrical portion 602. The second cylindrical portion 602 may include a tapered end 604. A portion of the second cylindrical portion 602 may be recessed to define a ridge 606 in the face of the second cylindrical portion 602. The ridge 606 may facilitate a snap-fit connection between the stem and an opening defined in the global layer.

Figure 7:
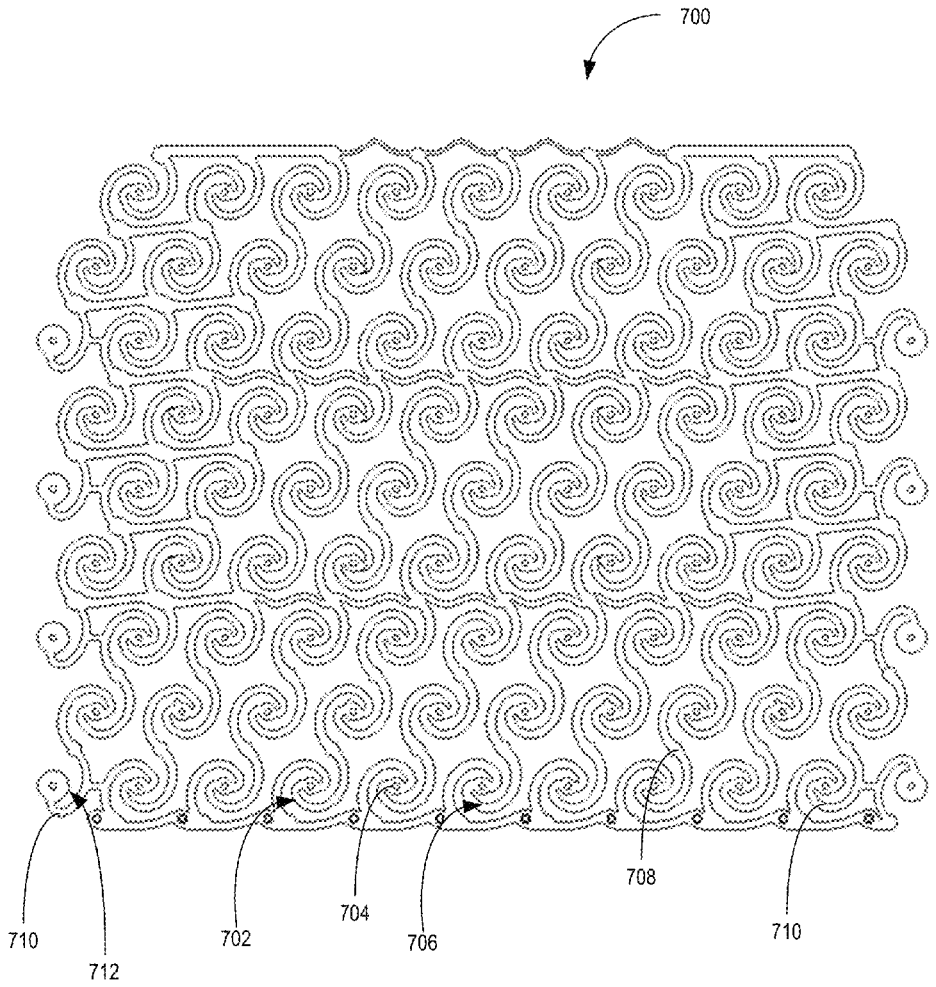
FIG. 7 shows a top view of an exemplary local layer.

FIG. 7 shows a top view of an exemplary local layer 700. The local layer 700 includes multiple spring elements 702 that each includes a top 704, a deflectable member 706, and a spring attachment member 708. The deflectable member 706 may include at least one spiraled arm 710. For example, FIG. 7 shows that some of the spring elements 712 near the edges of the local layer 700 include deflectable members having a single spiraled arm 710.

FIG. 8 shows a top view of a top mat layer 800 including a pixel region 802 and a bull nose region 804. The pixel region 802 includes multiple hexagonal pixels 806 interconnected at their corners with pixel connectors 808. Each of the multiple pixels includes an upper surface and a lower surface. The multiple pixels 806 are shown as hexagonal, but may take other shapes, such as rectangles, octagons, triangles, or other shapes. The lower surface includes a stem extending from the lower surface for connecting to the local layer.

Each of the multiple pixel connectors 808 interconnects three adjacent pixels 806. The multiple pixel connectors 808 may alternatively interconnect the multiple pixels 806 at their respective sides. The multiple pixels 806 may be planar, non-linear, and/or contoured.

The multiple pixels 806 may define openings within each pixel. The openings may add flexibility to the top mat layer 800 in adapting to a load. The top mat layer 800 may define any number of openings within each pixel 806, including zero or more openings. Additionally, each pixel 806 within the top mat layer 800 may define a different number of openings or different sized openings, depending, for example, on the pixel's respective position within the pixel region 802.

Figure 9:
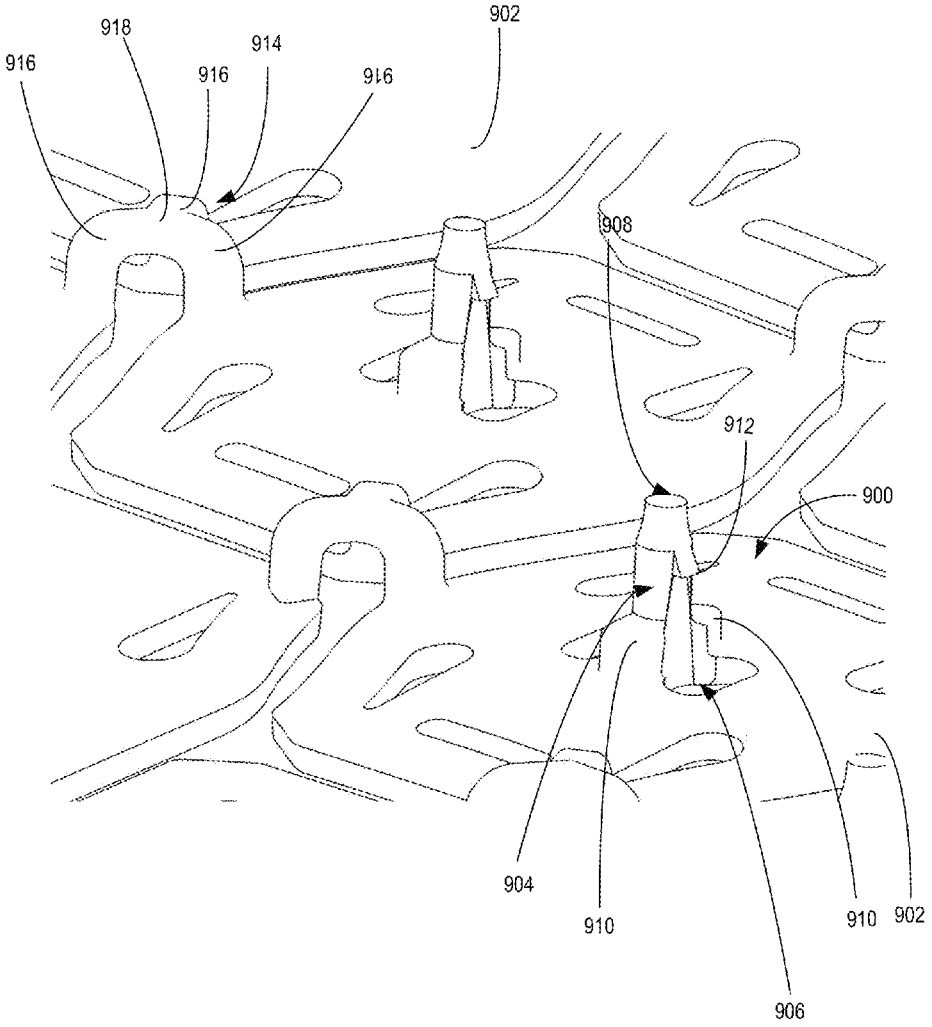
FIG. 9 shows the underside of a pixel within the top mat layer.

FIG. 9 shows the underside of a pixel 900 within the top mat layer 800 in which the lower surface 902 of the pixel 900 is shown facing upwards. In particular, FIG. 9 shows the lower surface 902 of the pixel and a stem 904 extending from the lower surface 902. The stem 904 may connect the pixel 900 to a spring element of a local layer. The connection between the stem 904 and a spring element may be an integral molding, a snap-fit connection, or another connection technique.

The stem may include two ends 906 and 908, a first end 906 connected to the lower surface of the pixel 902, and a second end 908 for connecting to the spring element. The stem 904 may include one or more shoulders 910 extending laterally from the stem 904, where the shoulder 910 has a height that is less than the height of the stem 904. The second end 908 of the stem 904 may be tapered. The second or tapered end 908 may include a lip 912 extending beyond the stem 904. To facilitate connection between the top mat layer and a local layer, the stem may be inserted into an opening defined in a top of the spring element. After the stem 904 passes a certain distance into the opening of the top of the spring element, the lip 912 may provide a catch to hold the stem 904 within the opening and resist removal of the stem 904. The lip 912 may catch on the lower surface of the top, on a ridge defined in an inside edge of the top opening, or on another surface.

The shoulders 910 may mate or otherwise be in contact with the upper surface of the top when the stem 904 passes through the top opening sufficiently for the lip to catch on the top and secure the pixel 900 to the top of the corresponding spring element. As an alternative, the stem 904 may omit the shoulders 910 and the lower surface 902 may contact with the upper surface of the top when the stem 904 mates with the top opening.

FIG. 9 shows a pixel connector 914 connecting adjacent pixels. In FIGS. 8 and 9, the pixel connectors 914 connect between the corners of three adjacent hexagonal pixels. The pixel connector 914 includes arched arms 916 connected to a corner of one of the pixels to provide slack for each pixel's independent movement when a load is applied. The arched arms 916 may extend from the corner and meet at a junction 918 between the pixels. The junction 918 may be below the plane defined by the interconnected pixels. Other shapes, such as an S-shape, or other undulating shape may be implemented as part of the pixel connector 914. The pixel connectors 914 may help reduce or prevent contact between adjacent pixels under deflection. The top mat layer 600 may alternatively omit the pixel connectors to increase the independence of the multiple pixels. While FIGS. 8 and 9 show pixel connectors 914 connected at the corners of the multiple pixels, the multiple pixels may alternatively be connected at their respective sides. The pixel connectors 914 may, for example, include a U-shaped bend connected between the sides of adjacent pixels.

Figure 10:
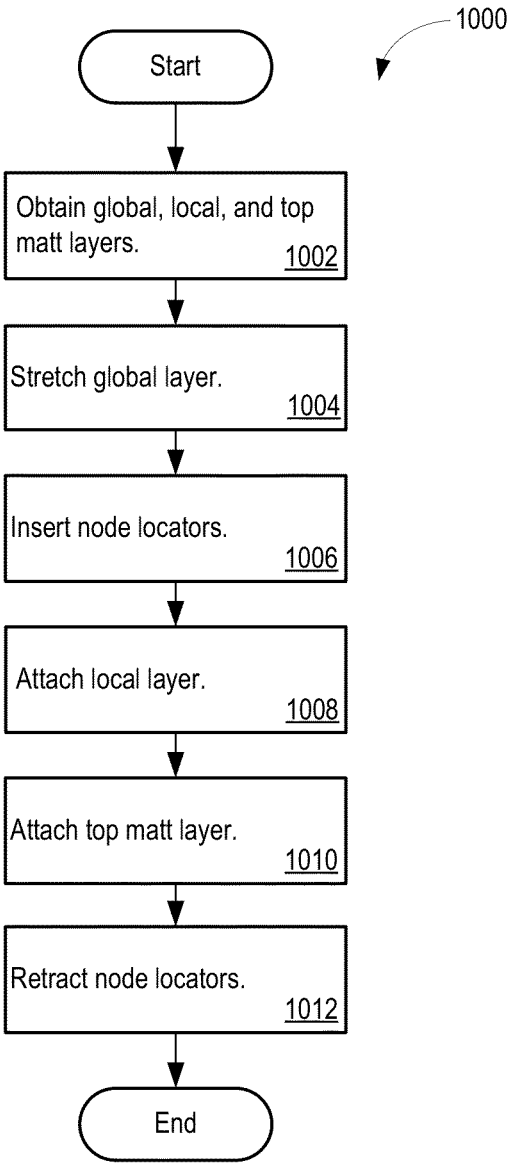
FIG. 10 is a process for manufacturing a layered support structure.

FIG. 10 is a process 1000 for manufacturing a layered support structure. The process 1000 may be may automated or executed manually. An assembly apparatus may be utilized to carry out the process 1000. The process 1000 obtains the global layer, local layer, and the top matt layer (1002). Each of the obtained global, local, and top mat layers may correspond to the layers described above, respectively.

One or more of the global layer, local layer, and top mat layer may be formed using an injection molding technique. The global layer may be formed using a center gated injection molding technique. The gates used in the cavity mold for the injection molding process may be located on the portion of the cavity mold corresponding to approximately the middle of each support rail. The cavity mold may include a gate corresponding to each support rail, or each strap of the support rails, or according to other configurations.

As discussed above, the global layer within a layered support structure includes straps with aligned and unaligned regions defined along the straps. Before alignment, the global layer may include pre-alignment regions defined along the straps. The pre-alignment regions may become the aligned regions after alignment or orientation of those regions. The global layer obtained for the process may have been previously aligned.

As an alternative, the process 1000 may align or orient the global layer (1004). The process 1000 may stretch the global layer to orient the pre-alignment regions. Other alignment techniques may also be used, including compression. The assembly apparatus may grip or otherwise hold opposite sides of the global layer and stretch the global layer along the direction of the support rails. The global layer may be stretched between approximately 10-12 inches. The stretching may also cause each pre-alignment region to stretch between approximately four to approximately eight times its original length.

Figure 11:
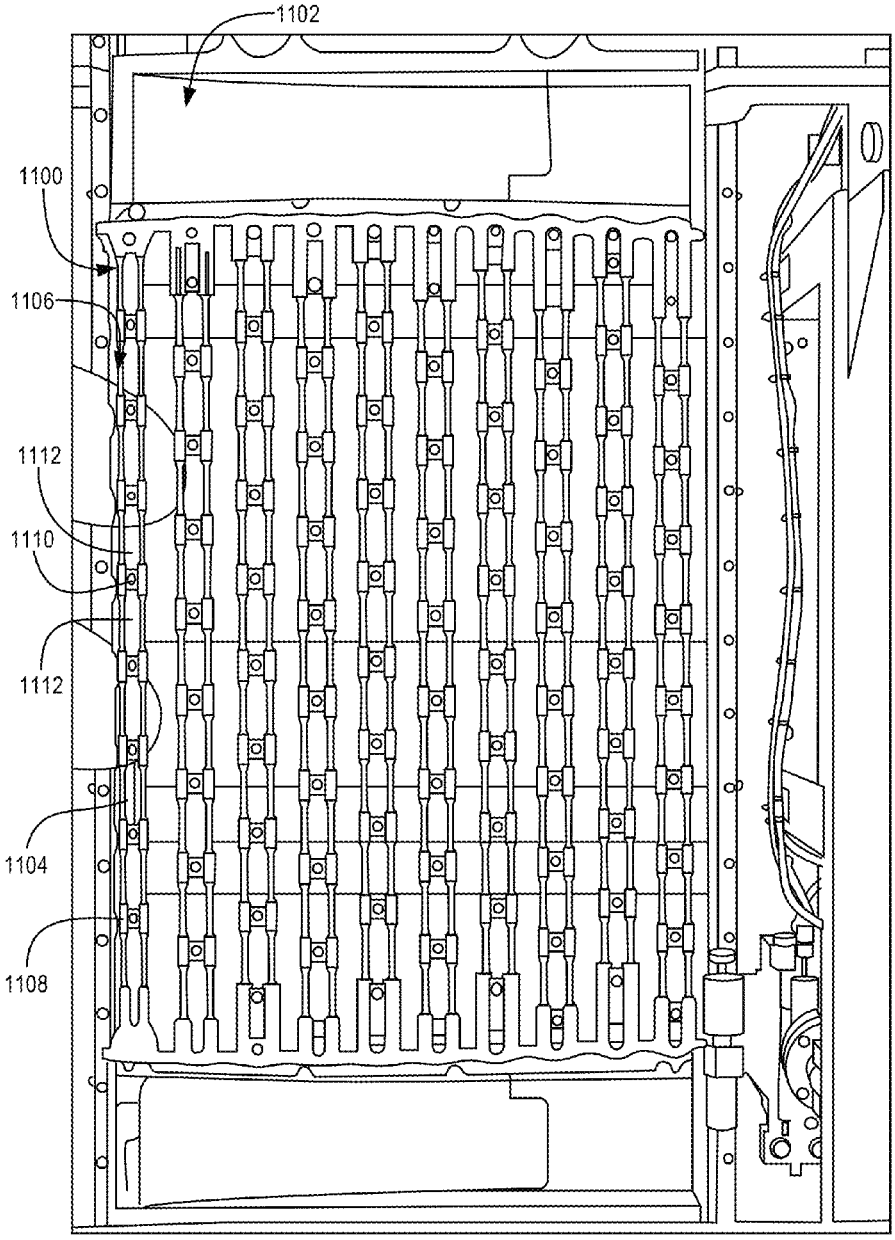
FIG. 11 shows a global layer stretched by an assembly apparatus.

FIG. 11 shows a global layer 1100 stretched by an assembly apparatus 1102. The aligned regions 1104 of the stretched global layer 1100 correspond to the thinner portions of each strap 1106. The unstretched or unaligned regions 1108 of the global layer correspond to the positions at which a node 1110 is connected between adjacent straps 1106. The global layer 1100 includes openings 1112 defined between adjacent nodes and adjacent straps of the global layer 1100. The cross-sectional area of each opening 1112 increases as the global layer 1100 is stretched.

While the global layer is stretched according to block 1004 of the process 1000, node locators may be inserted into the openings 1112 (1006). The node locators may be part of or separate from the assembly apparatus. The node locators may be blocks that fit in the openings 1112.

The process 1000 may connect the local layer to the global layer (1008). As discussed above, the local layer may include spring elements having spring attachment members that facilitate connection of the local layer to the global layer, such as the spring attachment member 508 shown in FIGS. 5 and 6. The process 1000 may guide the spring attachment members into corresponding openings defined in the nodes of the global layer until a snap-fit or other connection type is achieved.

The process 1000 connects the top mat layer to the local layer (1010). As discussed above, the top mat layer may include pixels having one or more stems extending downward from the pixels. The stems may facilitate connection of the top mat layer to the local layer. The process 1000 may guide the stems into corresponding openings at the top of each spring element until a snap-fit or other connection type is achieved.

The process 1000 may assemble the layered support structure in an upside-down orientation relative to the assembly apparatus, or relative to the orientation of the layered support structure's intended use (e.g., in a chair). For example, FIG. 10 shows the assembly apparatus from a top view perspective holding the global layer with its underside facing up, i.e., the side of the global layer viewable in FIG. 10 is the side that would typically face down in a chair application.

In this example, the node locators (according to 1006) may be inserted from above the upside-down oriented global layer down into the openings 1112. According further to this example, the process 1000 may connect the local layer to the global layer (according to 1008) by bringing the local layer, oriented upside-down relative to the assembly apparatus, and guiding the spring attachment members up into the corresponding openings defined by the nodes of the global layer until snap-fit or other connection type is achieved, such that the top of each spring element is oriented downward relative to the assembly apparatus. Likewise, the process 1000 may connect the top mat layer to the local layer (according to 1010) be bring the top mat layer, oriented upside-down relative to the assembly apparatus, and guiding the stems of the pixels up into corresponding openings at the top of each spring element until a snap-fit or other connection type is achieved, such that the top of the top mat layer is oriented downward relative to the assembly apparatus.

The process 1000 retracts the node locators (1012) from the assembled layered support structure. The process 1000 may secure the assembled layered support structure to a frame, such as the frame of a chair, or may provide the assembled layered support structure to another process for frame attachment.

Figure 12:
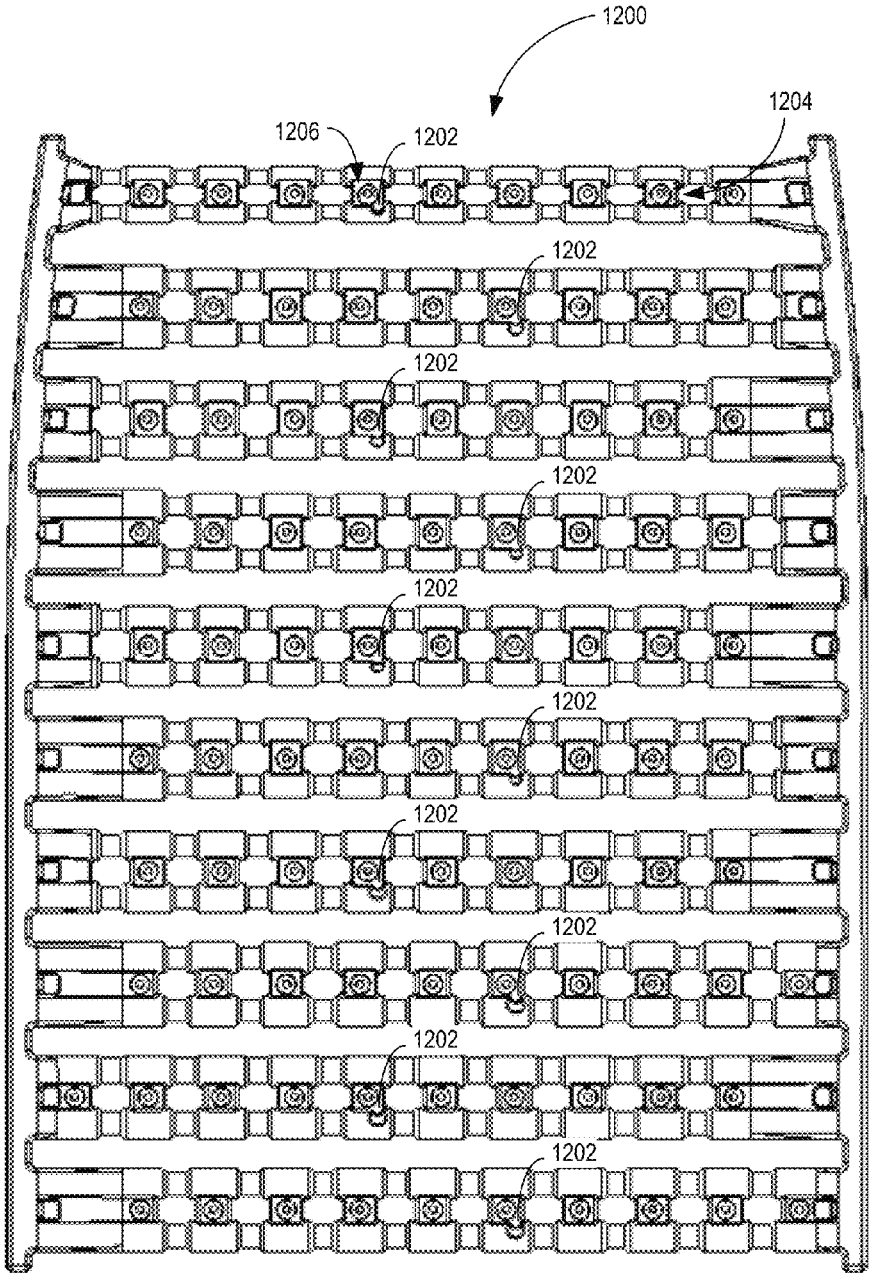
FIG. 12 shows a pre-aligned global layer.

FIG. 12 shows a pre-aligned global layer 1200. The pre-aligned global layer 1200 may be provided using an injection molding process. The gate locations 1202 for the molding process may be located at the center, or near the center of each pre-aligned support rail 1204. The gate locations 1202 may be located at a node 1206 or other portion of each pre-aligned support rail 1204. In FIG. 12, the gate location is at a node 1206 located near the center of each pre-aligned support rail 1204.

Figure 13:
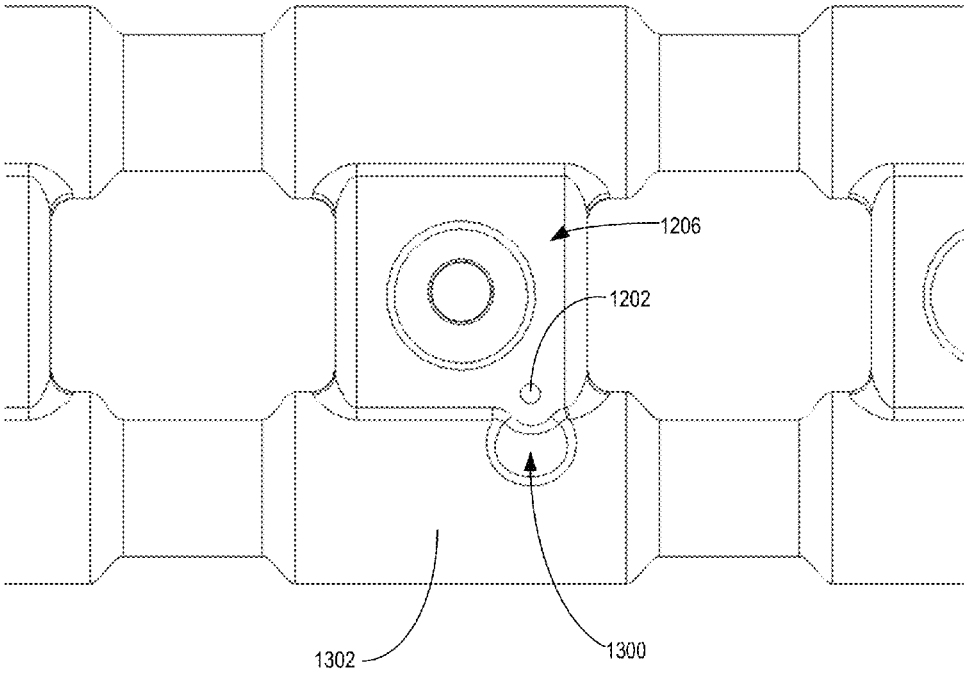
FIG. 13 shows a close-up view of a portion of a pre-aligned global layer.

FIG. 13 shows a close-up view of a portion of the pre-aligned global layer 1200 shows in FIG. 12. In particular, FIG. 13 shows the gate location 1202 on the node 1206. The hot drop depression 1300 in the unaligned region 1302 connected to the node 1206 may be product of the molding process. For example, the hot drop depression 1300 may correspond to a depression in the cavity mold for providing clearance to a hot drop tip.

Figure 14:
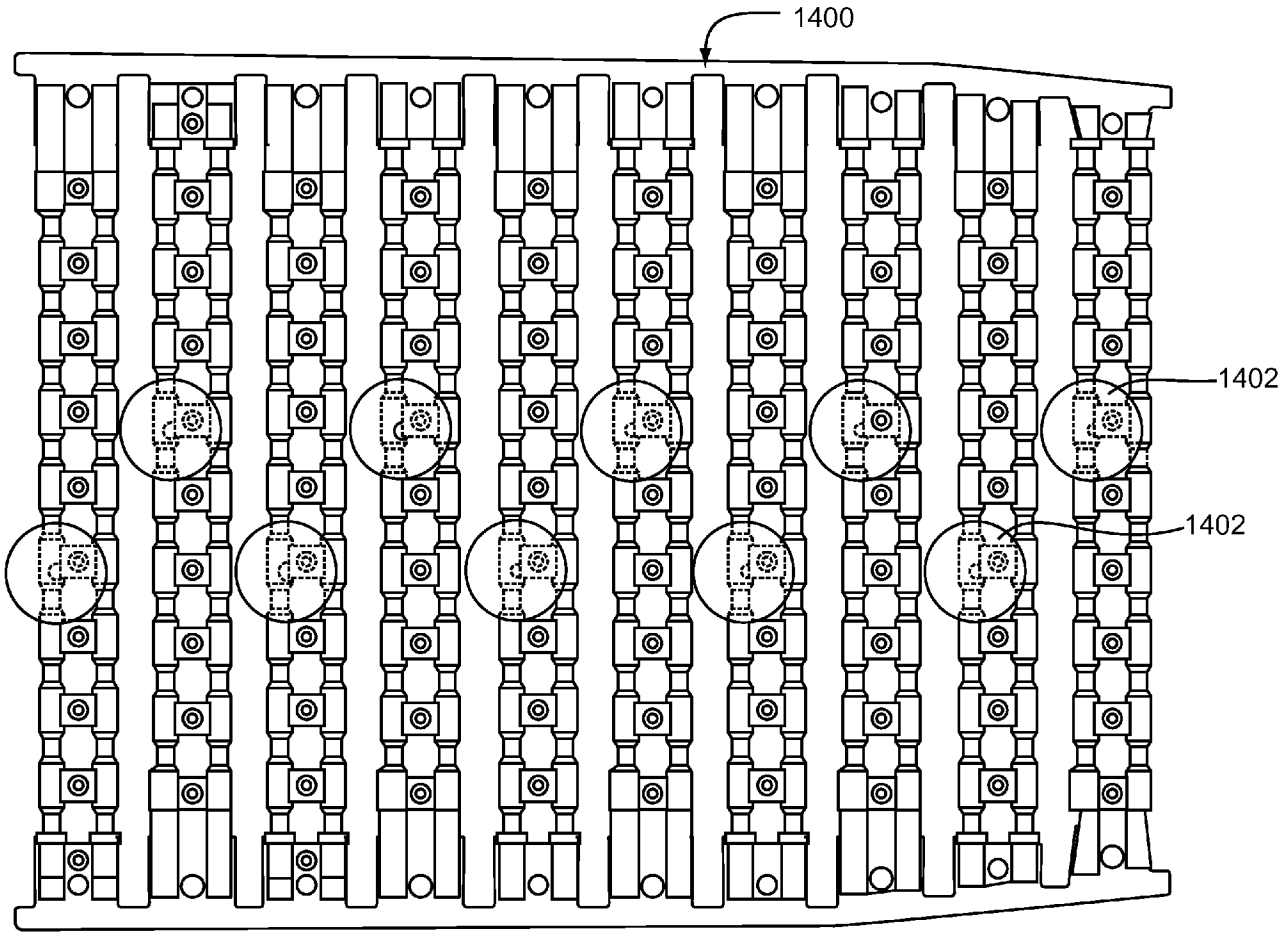
FIG. 14 shows a top view of a global layer cavity mold and hot drop channel for forming a pre-aligned global layer.

FIG. 14 shows a top view of a global layer cavity mold 1400 and hot drop channels 1402 for forming a pre-aligned global layer, such as the pre-aligned global layer 1200 shows in FIG. 12, though an injection molding process. The positions of the hot drops 1402 relative to the cavity mold correspond approximately to the gate locations of the mold.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

We claim:

1. A method for manufacturing a layered support structure, comprising:

providing a first layer comprising:

a support rail comprising:

a first strap comprising multiple pre-alignment regions and unaligned regions defined along the first strap;

a second strap substantially parallel to the first strap and comprising multiple pre-aligned regions and unaligned regions defined along the second strap;

multiple nodes connected between the first and second straps; and multiple openings defined along the support rail between an inside edge of adjacent nodes, an inside edge of the first strap, and an inside edge of the second strap, where the inside edges of adjacent nodes substantially face each other and the inside edges of the first and second straps substantially face each other;

providing a second layer comprising multiple spring elements supported by the nodes; and connecting the second layer to the first layer, where the second layer is positioned below the first layer after the connecting.

2. The method of claim 1, where the first layer is provided using an injection molding technique.

3. The method of claim 1, where the first layer is provided using a center gated injection molding technique.

4. The method of claim 1, further comprising aligning each of the multiple pre-alignment regions of the first and second straps to form multiple aligned regions defined along the first strap and the second strap.

5. The method of claim 4, where aligning each of the pre-alignment regions comprises:

stretching the first layer in a direction substantially parallel to the direction of the first and second straps; and inserting a node locator into each of the multiple openings.

6. The method of claim 5, where the first layer is stretched approximately 10-12 inches.

7. The method of claim 5, where the stretching causes each of the multiple pre-alignment regions to be stretched approximately four to eight times a pre-alignment length.

8. The method of claim 1, further comprising:

providing a third layer comprising multiple interconnected pixels supported by the second layer.

9. The method of claim 8, where the second and third layers are provided using an injection molding technique.

10. The method of claim 8, further comprising:

connecting the third layer to the second layer, where the third layer is positioned below the second layer after the connecting.

11. A method for manufacturing a layered support structure, comprising:

providing a first layer comprising:

a support rail comprising:

a first strap comprising multiple pre-alignment regions and unaligned regions defined along the first strap;

a second strap substantially parallel to the first strap and comprising multiple pre-aligned regions and unaligned regions defined along the second strap;

multiple nodes connected between the first and second straps; and multiple openings defined along the support rail between an inside edge of adjacent nodes, an inside edge of the first strap, and an inside edge of the second strap, where the inside edges of adjacent nodes substantially face each other and the inside edges of the first and second straps substantially face each other;

aligning each of the multiple pre-alignment regions of the first and second straps to form multiple aligned regions defined along the first strap and the second strap;

stretching the first layer in a direction substantially parallel to the direction of the first and second straps; and inserting a node locator into each of the multiple openings.

12. The method of claim 11, where the first layer is stretched approximately 10-12 inches.

13. The method of claim 11, where the stretching causes each of the multiple pre-alignment regions to be stretched approximately four to eight times a pre-alignment length.

14. The method of claim 11, where the first layer is provided using an injection molding technique.

15. The method of claim 11, further comprising:

providing a second layer comprising multiple spring elements supported by the nodes; and connecting the second layer to the first layer, where the second layer is positioned below the first layer after the connecting.

16. A method for manufacturing a layered support structure, comprising:

providing a first layer comprising:

a support rail comprising:

a first strap comprising multiple pre-alignment regions and unaligned regions defined along the first strap;

a second strap substantially parallel to the first strap and comprising multiple pre-aligned regions and unaligned regions defined along the second strap;

multiple nodes connected between the first and second straps; and multiple openings defined along the support rail between an inside edge of adjacent nodes, an inside edge of the first strap, and an inside edge of the second strap, where the inside edges of adjacent nodes substantially face each other and the inside edges of the first and second straps substantially face each other;

providing a second layer comprising multiples spring elements supported by the multiple nodes;

providing a third layer comprising multiple interconnected pixels supported by the second layer;

connecting the second layer to the first layer, where the second layer is positioned below the first layer after the connecting; and connecting the third layer to the second layer, where the third layer is positioned below the second layer after the connecting.

17. The method of claim 16, where the first layer is provided using an injection molding technique.

18. The method of claim 17, wherein the first layer is provided using a center gated injection molding technique.

19. The method of claim 16, further comprising aligning each of the multiple pre-alignment regions of the first and second straps to form multiple aligned regions defined along the first strap and the second strap, wherein the aligned regions comprise aligned material that is one of a compression aligned polymer material or a tension aligned polymer material.

20. The method of claim 16, where the second and third layers are provided using an injection molding technique.

* * * * *